US008704096B2

(12) United States Patent
Watanabe

(10) Patent No.: US 8,704,096 B2
(45) Date of Patent: Apr. 22, 2014

(54) COMPOSITE ELECTRIC WIRE

(75) Inventor: Jin Watanabe, Aichi (JP)

(73) Assignee: Yazaki Corporation, Tokyo (JP)

( * ) Notice: Subject to any disclaimer, the term of this patent is extended or adjusted under 35 U.S.C. 154(b) by 621 days.

(21) Appl. No.: 12/735,184

(22) PCT Filed: Nov. 21, 2008

(86) PCT No.: PCT/JP2008/071248
§ 371 (c)(1),
(2), (4) Date: Jun. 18, 2010

(87) PCT Pub. No.: WO2009/081679
PCT Pub. Date: Jul. 2, 2009

(65) Prior Publication Data

US 2010/0263912 A1 Oct. 21, 2010

(30) Foreign Application Priority Data

Dec. 21, 2007 (JP) ..... 2007-330771

(51) Int. Cl.
*H01B 5/00* (2006.01)

(52) U.S. Cl.
USPC ..... 174/126.1; 174/126.2

(58) Field of Classification Search
USPC ..... 174/36, 113 R, 120 R, 126.1, 126.2, 174/128.1, 128.2
See application file for complete search history.

(56) References Cited

U.S. PATENT DOCUMENTS

| | | | | | |
|---|---|---|---|---|---|
| 3,264,404 | A * | 8/1966 | Trebby et al. | ..... | 174/130 |
| 3,428,926 | A * | 2/1969 | Bogner et al. | ..... | 335/216 |
| 3,773,501 | A * | 11/1973 | Nakajima et al. | ..... | 148/439 |
| 3,811,846 | A * | 5/1974 | Schoerner et al. | ..... | 420/535 |
| 4,182,640 | A * | 1/1980 | Yokota | ..... | 148/438 |
| 4,919,769 | A * | 4/1990 | Lin | ..... | 205/138 |
| 5,110,545 | A * | 5/1992 | McAuliffe et al. | ..... | 420/534 |
| 5,223,349 | A * | 6/1993 | Kudo et al. | ..... | 428/652 |
| 6,204,452 | B1 * | 3/2001 | Valadez et al. | ..... | 174/126.1 |
| 6,642,456 | B2 * | 11/2003 | Valadez et al. | ..... | 174/126.1 |
| 6,674,011 | B2 * | 1/2004 | Ueno et al. | ..... | 174/128.1 |
| 6,982,385 | B2 * | 1/2006 | Wu | ..... | 174/126.1 |
| 2005/0121223 | A1 | 6/2005 | Wu | | |

FOREIGN PATENT DOCUMENTS

| | | | | |
|---|---|---|---|---|
| CN | 2879357 | Y | 3/2007 | |
| FR | 2844386 | A1 | 3/2004 | |
| JP | 63-167611 | | 11/1988 | |
| JP | 01-239708 | A | 9/1989 | |
| JP | 01-239708 | A1 * | 9/1989 | ..... H01B 5/08 |

(Continued)

OTHER PUBLICATIONS

International Search Report dated Mar. 17, 2009, issued on PCT/JP2008/071248.

(Continued)

*Primary Examiner* — William H Mayo, III
(74) *Attorney, Agent, or Firm* — Edwards Wildman Palmer LLP; James E. Armstrong, IV; Stephen D. LeBarron

(57) ABSTRACT

A composite electric wire that includes an electric wire body (W) composed of center conductors made of copper (CU) and outer-layer conductors made of aluminum (AL) and coated with copper. The outer-layer conductors are arranged to extend in a Z-direction along the outer circumferences of the center conductors (CU) and to enclose the center conductors (CU).

4 Claims, 2 Drawing Sheets

(56) References Cited

FOREIGN PATENT DOCUMENTS

| | | | |
|---|---|---|---|
| JP | 11-181593 | A | 7/1999 |
| JP | 2000-090744 | A | 3/2000 |
| JP | 2004-039477 | A | 2/2004 |
| JP | 2004-207079 | A | 7/2004 |
| JP | 2006-147237 | A | 6/2006 |
| JP | 2006-147507 | A | 6/2006 |
| JP | 2006-339040 | A | 12/2006 |

OTHER PUBLICATIONS

Office Action mailed May 4, 2011, issued for the corresponding Chinese Patent Application No. 200880126359.6 and partial English translation thereof.

European Search Report dated Dec. 5, 2011 issued in connection with European Application No. 08864002.4.

European Office Action dated Apr. 12, 2013 in connection with corresponding European Application No. 08 864 002.4-1903.

* cited by examiner

COMPOSITE ELECTRIC WIRE

CROSS REFERENCE TO RELATED APPLICATIONS

This application is related to co-pending application: "COMPOSITE ELECTRIC WIRE" filed even date herewith in the names of Jin WATANABE as a national phase entry of PCT/JP2008/071247, which application is assigned to the assignee of the present application and is incorporated by reference herein.

TECHNICAL FIELD

This invention relates to a composite electric wire having different types of element wires arranged at a center portion and at an outer circumference portion, in particular, to a composite electric wire suitable for use as a wire harness to be mounted on a vehicle or the like.

BACKGROUND

Conventionally, a copper electric wire is typically used as a wire harness routed in a vehicle or the like because of its good electrical conductivity. However, recently, a demand for replacing the copper electric wire with an aluminum electric wire has been increased in view of low weight, good fuel economy owing to the low weight, and recycle of metal resources in addition to a lack of copper resources, and price increase due to the lack of copper resources.

Because aluminum has high electric conductivity next to copper, and good workability for wire drawing, and is light-weight (specific gravity is one third of that of copper), conventionally, aluminum is used as electric wire material mainly in use of aerial power cable, aerial distribution line, or the like.

Here, as an exemplary aluminum wire, an aluminum wire only composed of stranded aluminum element wire or stranded aluminum alloy wire, and an aluminum wire composed of stranded copper coated aluminum wire (for example, see Patent Document 1) are known.

However, conventional aluminum wire composed of aluminum element wire or aluminum alloy element wire is not suitable for in-vehicle environment. Namely, in vehicle environment, high strength against bending or pulling of the wire is required because of the necessity of routing the wire in a limited space, however, the aluminum wire having less strength than the copper wire is limited in a range of application of in-vehicle environment in view of environmental resistance (high temperature, high humidity, bending, pulling, or the like).

Therefore, for solving these problems, a composite electric wire having aluminum element wire in a center portion, and molten aluminum coated iron wire in its surrounding portion is proposed (for example, see Patent Document 2).

Further, steel core aluminum stranded wire composed of steel stranded wire in a center portion and aluminum stranded wire in its surrounding portion, and steel core aluminum stranded wire composed of invar stranded wire instead of steel wire are known (for example, see Patent Document 3).

Patent Document 1: JP, A, H11-181593
Patent Document 2: JP, A, 2006-339040
Patent Document 3: JP, A, 2000-90744

DISCLOSURE OF THE INVENTION

Problem to be Solved by the Invention

Incidentally, when using the aluminum element wire as a part of or all of the conductor, because the aluminum has a property to generate an oxide coating on its outer surface as soon as the outer surface touches the air, and the oxide coating negatively affects the electric characteristics of the electric wire, there is a problem that it is difficult to handle the electric wire. For example, when the electric wire is used in an on-vehicle wire harness and connected to a terminal, it is necessary to pay attention to the oxide coating. In addition, when combining with a dissimilar metal and used as the composite electric wire, there is a problem that electrical erosion of the aluminum element wire is generated because of the electrical potential difference between dissimilar metals caused by contacting the dissimilar metals each other.

Accordingly, in view of the above problems, it is an object of the present invention to provide a composite electric wire, which is intended to realize a light weight and improve a mechanical strength at the same time and which is enabled to improve the reliability by avoiding the problems of oxide coating and electric erosion so that the electric wire may be easily handled for use as an on-vehicle wire harness.

Means for Solving Problem

The object of the present invention will be accomplished with a configuration described below.

(1) A composite electric wire comprising:

an electric wire body composed of center conductors; and outer-layer conductors arranged to extend in a longitudinal direction along outer circumferences of the center conductors and to enclose the center conductors, wherein each of the center conductor is composed of at least one copper element wire, and the outer-layer conductors are composed of a plurality of copper-coated aluminum element wires, wherein the center conductors are sectionally positioned at a center portion of the electric wire body in a plane perpendicular to a longitudinal direction of the electric wire body, and the outer-layer conductors are sectionally positioned in an outer circumference portion around the center portion, and wherein the outer-layer conductors make contact at their outer circumferences with the outer circumferences of the center conductors to make their electric connections.

(2) The composite electric wire as described in (1), wherein each of the plurality of copper-coated aluminum element wires is a copper-clad aluminum element wire made by diffusion bonding at a bonded interface between a metal including aluminum and copper.

(3) The composite electric wire as described in (1) or (2), wherein copper included in the at least one copper element wire and copper composing the plurality of copper-coated aluminum element wires are the same copper material.

According to a configuration of (1), because the composite electric wire is made by the center conductors composed of the copper element wires at the center portion in the plane perpendicular to the longitudinal direction of the electric wire body, and the outer conductors composed of the copper-coated aluminum element wires, the composite electric wire can be lighter weight than an electric wire composed totally of copper element wires. Further, the tensile strength and the bending strength of the composite electric wire can be increased compared with an electric wire composed totally of the aluminum element wires or the aluminum alloy element wires. Further, the electrical conductivity can be increased (reduction of the resistance of the electric wire). Further, the tensile strength of the composite electric wire can be increased compared with the electric wire composed totally of copper-clad aluminum element wires as an embodiment of the copper-coated aluminum element wire.

In particular, a lot of element wires are needed for forming the outer circumference of the electric wire body, however, because the outer-layer conductors arranged at the outer circumference of the electric wire body are composed of the copper-coated aluminum element wires, the number of the copper-coated aluminum element wires can be easily increased, and resultingly, the electric wire can be further lightweight. Further, because the center conductors are composed of the copper element wires of which strength is higher than that of the aluminum element wires, the tensile strength of the electric wire can be increased.

Further, as described above, when the aluminum element wire or the aluminum alloy element wire is used without modification, there is a problem that an oxide coating is generated on a surface of the element wire. However, the copper-coated aluminum element wire is used in place of these element wires, the problem of the oxide coating is not generated.

Further, when the aluminum element wire or the aluminum alloy element wire is used as the center conductors without modification, and electrically contacts with the outer-layer conductors composed of copper-coated aluminum element wires in a manner that the outer-layer conductors make contact at their outer circumferences with the outer circumferences of the center conductors, the contact between the center conductors and the outer-layer conductors is the contact between copper and aluminum, thereby there is a fear of electrical erosion of the aluminum element wire or the aluminum alloy element wire due to electrical potential difference between dissimilar metals. However, in the composite electrical wire having this configuration, because the copper-coated aluminum element, which is made by covering an outer circumference of the aluminum element wire or the aluminum alloy element wire with copper, is used, the contact between the outer-layer conductor which is composed of the copper-coated aluminum element wire and the center conductor composed of the copper element wire is the contact between the same metal, thereby no electrical potential difference is generated on the contact surface, and the electrical erosion is surely prevented.

Further, the center conductors and the outer-layer conductors are extended in the longitudinal direction of the electric wire body and substantially parallel to each other. Therefore, when the composite electric wire is cut to be used at an arbitrary cross-section, dispersion of characteristic (such as press-bonding property, tensile strength or the like) of the cut composite electric wire is regulated, and reliability as the electric wire is improved.

Therefore, as described above, according to this configuration, the composite electric wire has an environment resistance and is sufficiently used in the on-vehicle environment. The composite electric wire can be used in place of the copper electric wire in a wide variety of applications for a vehicle. When the composite electric wire is used in an on-vehicle wire harness, the composite electric wire contributes to a vehicle weight saving due to a weight saving of the wire harness. Further, the composite electric wire can avoid the problem of oxide coating and electric erosion, the reliability of the electric wire is improved. When used in an on-vehicle wire harness, the handling of the composite electric wire is easy because there is no need to be concerned about generation of the oxide coating. Incidentally, the "aluminum" of "the copper-coated aluminum element wire" means a metal including aluminum, which includes, of course pure aluminum, and an aluminum alloy with such as iron, copper, manganese, silicon, magnesium, zinc, nickel or the like.

According to the configuration of (2), because the copper-clad aluminum element wire is used as the copper-coated aluminum element wire, a strong junction force is generated on an interface between the metal wire including aluminum and the copper coating. Therefore, upon the pressure-bonding, the copper coating is prevented from abrasion, and a metal surface including aluminum is surely prevented from generating the oxide coating.

According to the configuration of (3), because copper included in the copper-coated aluminum element wire composing the outer circumference of the center conductor and copper of the copper element wires are the same copper material, the contact between the copper element wire as the outer-layer conductor and the center conductor is the contact between the complete same metals of copper and copper, and no electrical potential difference is generated at the contact surface, so that the electric erosion is further surely prevented.

Effects of Invention

According to the present invention, the composite electric wire is intended to realize a light weight and improve a mechanical strength at the same time. Further, the composite electric wire is enabled to improve the reliability by avoiding the problems of oxide coating and electric erosion so that the electric wire may be easily handled for use as an on-vehicle wire harness.

As described above, the present invention is briefly explained. A detail of the present invention will be apparent by reading the best mode for carrying out the invention as explained later with reference to attached drawings.

EXPLANATIONS OF LETTERS OR NUMERALS

CU center conductor
AL outer-layer conductor
10 copper element wire
20 copper-coated aluminum element wire
21 aluminum element wire
22 copper clad layer (copper coating)

BEST MODE FOR CARRYING OUT THE INVENTION

Figure 1:
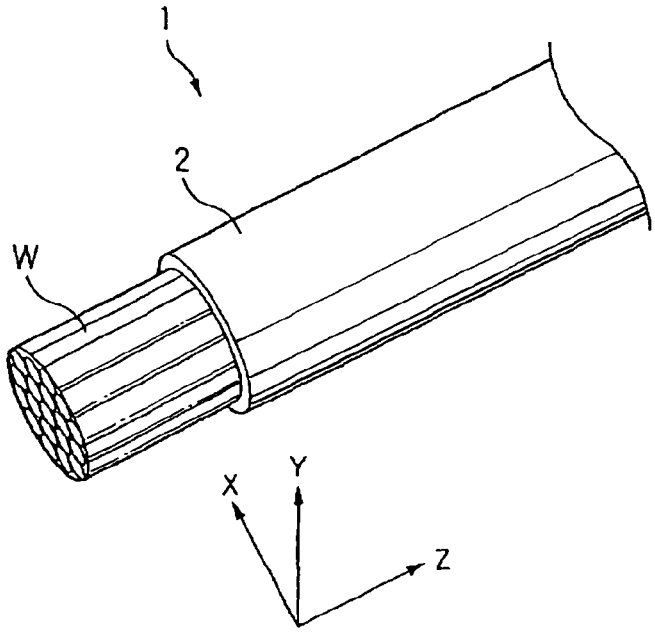
FIG. 1 A perspective view showing an electric wire according to an embodiment of the present invention.
Figure 2:
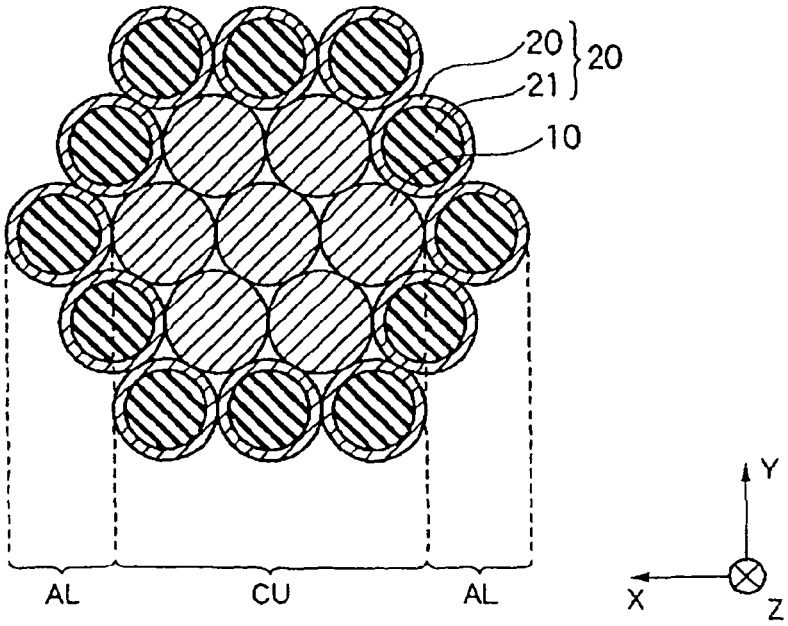
FIG. 2 A sectional view showing conductors of the electric wire according to the embodiment of the present invention.
Figure 3:
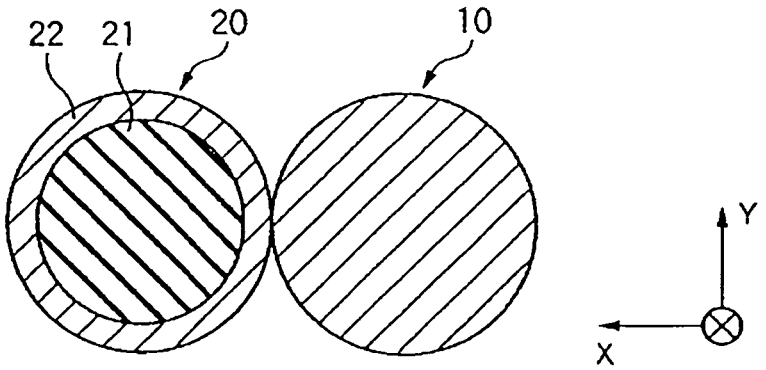
FIG. 3 An enlarged view showing a contact portion between a copper element wire and a copper-coated aluminum element wire of the electric wire according to the present invention.

Hereinafter, a preferred embodiment according to the present invention will be explained with reference to figures. FIG. 1 is a perspective view showing an electric wire according to the embodiment. FIG. 2 is a sectional view showing conductors of the electric wire according to the embodiment. FIG. 3 is an enlarged view showing a contact portion between a copper element wire and a copper-coated aluminum element wire of the electric wire according to the present invention. Incidentally, a longitudinal direction of a composite electric wire (electric wire body) is defined as "Z direction", and a plane perpendicular to the Z direction, namely, a plane including a section of the electric wire body is defined as "X-Y plane", and explained below.

As shown in FIG. 1, a composite electric wire 1 according to this embodiment includes: an electric wire body W composed of center conductors CU and outer-layer conductors AL arranged to extend in the Z direction along the outer circumferences of the center conductors CU and to enclose the center conductors CU; and a cover 2 surrounding the outer circumference of the electric wire body W and extending in the Z direction. Incidentally, the cover 2 is provided for protecting the electric wire body W from outer shock or the like, and made by molding resin or the like.

As shown in FIG. 2, in the electric wire body W, the center conductors CU composed of copper element wires 10 of a (1+6) number are sectionally positioned at the center portion of the electric wire body W in the X-Y plane, and the outer-layer conductors AU composed of twelve copper-coated aluminum element wires 20 are positioned in the outer circumference portion arranged around the center portion of the X-Y plane. Moreover, the outer-layer conductors AL make contact at their outer circumferences with the outer circumferences of the center conductors CU, thereby to make their electric connections. Incidentally, at this time, the copper-coated aluminum element wires 20 and the copper element wires 10 are respectively stranded.

Here, a diameter of the copper element wires 10 and a diameter of the copper-coated aluminum element wires 20 are formed substantially equal to each other. The copper-coated aluminum element wires 20 is the aluminum element wires 21 each of which outer surface is coated with the copper clad layer (copper coating) 22, and more specifically, a copper-clad aluminum element wire diffusion-bonding at a junction interface between aluminum and copper. In addition, the copper of the copper clad layer 22 of the copper-coated aluminum element wires 20 and the copper of the copper element wires 10 are made of the same copper material.

The electric wire body W of the composite electric wire 1 includes: the center conductors CU composed of the copper element wires 10 at the center portion of the X-Y plane; and the outer-layer conductors AL composed of the copper-coated aluminum element wires 20 at the outer circumference portion of the X-Y plane. Therefore, the composite electric wire 1 can be lightweight compared to an electric wire totally composed of the copper element wires 10. Further, the tensile strength and the bending strength of the composite electric wire 1 can be increased compared to an electric wire totally composed of the aluminum element wires 21, and the electrical conductivity can be increased (electric wire resistance can be reduced). Further, the tensile strength can be increased compared to an electric wire totally composed of the copper-clad aluminum element wires.

In particular, a lot of element wires are needed for forming the outer circumference of the electric wire body W, however, according to this embodiment, because the outer-layer conductors AL arranged at the outer circumference of the electric wire body W are composed of the copper-coated aluminum element wires 20, the number of the copper-coated aluminum element wires 20 can be easily increased, and resultingly, the electric wire can be further lightweight. Further, because the center conductors CU are composed of the copper element wires 10 of which strength is higher than that of the aluminum element wires 20, the tensile strength of the electric wire can be increased.

Further, when the aluminum element wires 21 are used without modification, there is a problem that an oxide coating is generated on a surface of the aluminum element wire 21. However, the copper-coated aluminum element wires 20 are used in place of the aluminum element wires 21, the oxide layer problem is never generated.

Further, when the aluminum element wires 21 are used as the center conductors without modification, and electrically contact with the outer-layer conductors AL composed of copper-coated aluminum element wires 20 in a manner that the outer-layer conductors AL make contact at their outer circumferences with the outer circumferences of the center conductors CU, the contact between the center conductors CU and the outer-layer conductors AL is the contact between copper and aluminum, thereby there is a fear of electrical erosion of the aluminum element wires 21 due to electrical potential difference between dissimilar metals. However, as shown in FIG. 3, in the composite electrical wire 1 according to this embodiment, because the copper-coated aluminum element 20, which is made by covering outer circumferences of the aluminum element wires 21 with the copper clad layer (copper coating) 22, is used, the contact between the outer-layer conductors AL which are composed of the copper-coated aluminum element wires 20 and the center conductors CU is the contact between the same metal of copper and copper, thereby no electrical potential difference is generated on the contact surface, and the electrical erosion is surely prevented.

Incidentally, in this embodiment, because copper included in the copper clad layer 22 of the copper-coated aluminum element wire 20 and copper of the copper element wire 10 are the same copper material, the contact is the contact between the complete same metals of copper and copper, and no electrical potential difference is generated at the contact surface, so that the electric erosion is further surely prevented.

Further, the center conductors AL and the outer-layer conductors CU are extended in the Z direction and substantially parallel to each other. Therefore, when the composite electric wire 1 is cut to be used at an arbitrary X-Y plane, dispersion of characteristic (such as press-bonding property, tensile strength or the like) of the cut composite electric wire is regulated, and reliability as the electric wire is improved.

Further, in this composite electric wire 1, because the copper-clad aluminum element wire is used as the copper-coated aluminum element wire 20, a strong junction force is generated on an interface between the aluminum element wire 21 and the copper clad layer 22. Therefore, upon the pressure-bonding, the copper clad coating 22 is prevented from abrasion, and a surface of the aluminum element wire 21 is surely prevented from generating the oxide coating.

Therefore, as described above, according to this configuration, the composite electric wire has an environment resistance and is sufficiently used in the on-vehicle environment. The composite electric wire can be used in place of the copper electric wire in a wide variety of applications for a vehicle. When the composite electric wire is used in an on-vehicle wire harness, the composite electric wire contributes to a vehicle weight saving due to a weight saving of the wire harness. Further, the composite electric wire can avoid the problem of oxide coating and electric erosion, the reliability of the electric wire is improved. When used in an on-vehicle wire harness, the handling of the composite electric wire is easy because there is no need to be concerned about generation of the oxide coating.

Incidentally, the present invention is not limited to the above-described embodiment, and a modification, a reform or the like are allowed. In addition, material, shape, size, number, location or the like of each component in the above-described embodiment are arbitrary and not limited as long as they can attain the present invention.

For example, in the above-described embodiment, the number of the copper element wires 10 composing the center conductors CU is seven, and the number of the copper-coated aluminum element wires 20 composing the outer-layer conductors AL is twelve. However, these numbers of the copper element wires 10 and the copper-coated aluminum element wires 20 may be more or less. When a ratio of the copper-coated aluminum element wires 20 is increased, a contribution ratio of the lightweight is increased, on the other hand, when a ratio of the copper element wires 10 is increased, a contribution ratio of the tensile strength is increased.

Further, in this embodiment, the aluminum of the copper-coated aluminum element wire 20 is not limited to pure aluminum, and may be a metal including aluminum, which includes an aluminum alloy with such as iron, copper, manganese, silicon, magnesium, zinc, nickel or the like. In these cases, the present invention can be practiced similar to the above, and the same function and effect as the above are achieved.

Incidentally, as a preferred specific example of the aluminum alloy, an alloy of aluminum and iron is illustrated. When this alloy is employed, the electric wire is easy to be extended, and the strength (in particular, tensile strength) is increased compared to a conductive wire made of pure aluminum Therefore, this alloy is preferable.

Further, in the present invention, as the copper-coated aluminum element wire 20, a copper-plating aluminum element wire made by plating an outer surface of the aluminum element wire with copper, or a copper-plating aluminum alloy element wire made can be employed.

The invention claimed is:

1. A composite electric wire comprising:

an electric wire body composed of center conductors arranged in a 1+6 configuration; and twelve outer-layer conductors arranged to extend in a longitudinal direction along outer circumferences of the center conductors and to enclose the center conductors, wherein each of the center conductor is composed of at least one copper element wire, and the outer-layer conductors are composed of a plurality of copper-coated aluminum element wires, wherein the center conductors are sectionally positioned at a center portion of the electric wire body in a plane perpendicular to a longitudinal direction of the electric wire body, and the outer-layer conductors are sectionally positioned in an outer circumference portion around the center portion, and wherein the outer-layer conductors make contact at their outer circumferences with the outer circumferences of the center conductors to make their electric connections.

2. The composite electric wire as claimed in claim 1, wherein each of the plurality of copper-coated aluminum element wires is a copper-clad aluminum element wire made by diffusion bonding at a bonded interface between a metal including aluminum and copper.

3. The composite electric wire as claimed in claim 2, wherein copper included in the at least one copper element wire and copper composing the plurality of copper-coated aluminum element wires are the same copper material.

4. The composite electric wire as claimed in claim 1, wherein copper included in the at least one copper element wire and copper composing the plurality of copper-coated aluminum element wires are the same copper material.

* * * * *